US007475845B2

(12) United States Patent
Meier et al.

(10) Patent No.: US 7,475,845 B2
(45) Date of Patent: Jan. 13, 2009

(54) AXIAL BEARING FOR A BANDING ROLL

(75) Inventors: Ernst Meier, Beinwil am See (CH); Alois Tanner, Fahrwangen (CH)

(73) Assignee: ATS Automatic Taping Systems AG, Zug (CH)

( * ) Notice: Subject to any disclaimer, the term of this patent is extended or adjusted under 35 U.S.C. 154(b) by 241 days.

(21) Appl. No.: 10/582,814

(22) PCT Filed: Jan. 19, 2005

(86) PCT No.: PCT/CH2005/000028

§ 371 (c)(1),
(2), (4) Date: Jun. 14, 2006

(87) PCT Pub. No.: WO2005/070766

PCT Pub. Date: Aug. 4, 2005

(65) Prior Publication Data

US 2007/0158490 A1 Jul. 12, 2007

(30) Foreign Application Priority Data

Jan. 21, 2004 (CH) ..... 0076/04

(51) Int. Cl.
*B65H 16/04* (2006.01)

(52) U.S. Cl. ..... 242/597.1; 242/597.2; 242/597.6; 242/578; 242/608.5

(58) Field of Classification Search ... 242/597.1–597.2, 242/597.4–597.6, 608.5, 578, 118.61
See application file for complete search history.

(56) References Cited

U.S. PATENT DOCUMENTS 1,394,177 A * 10/1921 Jones ..... 403/247
2,157,153 A * 5/1939 Troche ..... 226/194
4,726,179 A * 2/1988 Smith et al. ..... 57/129
5,232,174 A * 8/1993 Sato et al. ..... 242/578
6,820,838 B2 * 11/2004 Martin et al. ..... 242/588.1

FOREIGN PATENT DOCUMENTS

EP 0 456 604 4/1991
EP 055 1 244 1/1993

* cited by examiner

*Primary Examiner*—Peter M Cuomo
*Assistant Examiner*—Sang Kim
(74) *Attorney, Agent, or Firm*—Bachman & LaPointe, P.C.

(57) ABSTRACT

An axial bearing, for a spooling roller on a spooling machine, with a shaft fixed to a machine frame, or to a machine chassis, a fixed rear cover disc, a hub freely rotating about the shaft and a flange, arranged on the free front face of the shaft with a front cover disc. At least one stud chamfers in the radial direction, away from the shaft in the region of the flange, engaging in but without projecting beyond a guide slot of a bayonet sleeve, detachably connected to the flange. The open guide slot, on the front face, rises up to an arched peak, turns away from the front face of the bayonet sleeve at a separation and runs toward the front face with a blind terminus. A pressure spring, tensioned on the shaft, is arranged between a shaft mounting and the hub, which presses the roller core with the spooling roller, over the hub, in the axial direction on the flange and forms therewith a rapid closure with the centered spooling roller. The separation (a) corresponds to the separating of the roller core, or the mounted but not yet pressurized spooling roller, from the rear cover disc.

11 Claims, 6 Drawing Sheets

FIG..1

AXIAL BEARING FOR A BANDING ROLL

BACKGROUND OF THE INVENTION

The invention relates to an axial bearing for a banding roll of a banding machine with a shaft which is rigidly attached to a machine frame or chassis, and a rear cover plate which is also rigidly attached, a hub which is freely rotatable on the shaft and a flange which is arranged on the free face of the shaft with a front cover plate.

In banding machines, a strip-like film of paper, plastic or a composite is guided in a band guide, limiting the extension, as a loop about a stack of packaged products. This band guide is formed as an open or closed loop depending on the rigidity of the banding, the dimensions and use of the banded stack of packed product.

Basically, the goods to be packaged and to be banded can be configured in any manner, for example square, rectangular, round or trapezoidal with regard to area. At least one banding roll is positioned, simultaneously or successively in the case of several.

A fully automatic banding machine first forms an inherently stable or raised loop in which is placed the stack of packed products. The stack of packed products can be inserted before the loop is formed, sensor-controlled or triggered by hand or foot switch, the package band which is firmly clamped at its free end is retracted until it lies firmly against the packed products. Then the clamped end is glued or welded to the package band and cut.

The basic principle of banding is known on a broad basis. EP 0551244 A1 describes a banding machine which comprises cold welding. This refinement ensures a clean closure, requires little maintenance, and prevents deposits of burnt film and the replacement of heating elements.

Although at present banding rolls provide up to around 800 m of paper or even 1300 m of film, they must be changed relatively frequently during continuous operation. In non-specialised operations small banding rolls are used and replaced as required. A roll change must therefore be as simple as possible with relation to clamping of the roll and threading of the band.

Conventional band widths for package band are 15, 20, 30, 40, 50, 60, 75 and 100 mm. Compared to the width, the diameter is large to very large, so to avoid lateral offsets cover plates are arranged on both sides which do not rotate during unrolling.

Banding rolls have a roll core of cardboard which is pushed onto the freely rotating hubs. Due to unavoidable production tolerances the banding rolls are occasionally pushed on insufficiently, where roll-wound package band that is laterally offset grinds on a cover plate, a braking effect occurs causing the band tightening motor to be overloaded. Operating interruptions that are time-consuming and have a negative effect on production costs should be avoided as a precaution.

The invention is based on the object of creating an axial bearing of the type cited initially which allows a simpler roll change and fault-free operation as far as possible.

SUMMARY OF THE INVENTION

The object is achieved according to the invention in that in the area of the flange at least one bolt protrudes radially from the shaft and engages without protrusion in a guide slot of a bayonet socket which is detachably connected with the flange, which guide slot is open at its face transforms rising into a curved apex, turns at a spacing a from the face of the bayonet socket and runs ending blind in the direction of the face of the bayonet socket; a compression spring is arranged clamped between a shaft holder and the hub on the shaft and presses the roll core with the banding roll over the hub in the axial direction against the flange and together with this forms a fast closure with the centred banding roll, where the spacing a corresponds to the spacing of the roll core of the banding roll, inserted and not yet pressed on, from the rear cover plate. Advantageous and refined embodiments of the axial bearing are the object of dependent claims.

The central element of the invention is the bayonet socket which is mounted longitudinally displaceably and simultaneously rotatably on the rigid shaft according to the guide slot with the bolt inserted therein. The guide slot with the curved apex, in a first phase on continuous rotation of the flange, allows the banding roll to be pressed by the front on the rear cover plate and lateral offsets to be corrected. On further rotation, the banding roll, because of retraction of the flange and the effect of the compression spring, again becomes spaced from the rear cover plate and held in the end position approximately centrally between the two cover plates. Rotation in the same direction allows in the first phase the two cover plates to straighten the banding roll and in the second phase after reaching the stop the roll to be placed approximately centrally between the cover plates. The end position of the guide slot can also have a catch.

With suitable means, in particular with a bolt, the axial position of the bayonet socket can be positioned and locked corresponding to the band width of the banding roll. Use of the same axial bearing for different band widths is of considerable economic importance.

The course of the guide slots is in itself arbitrary, these are normally formed rising linear and transform into a circular arc and then run linear again down to the blind end. They can however also rise degressively. Preferably the gradient has an angle $\alpha$ from 30 to 60°, preferably around 45°, and after the curve returns in the same angle range to the blind end. With regard to the spacing of this blind end from the apex face of the bayonet socket, the guide slot is set back from 0.3 to 0.7 a, preferably around 0.5 a. At the latter value of 0.5 a, the banding roll lies centrally between the two cover plates, which is normally desirable.

Spacing a is matched to the special conditions of the axial bearing. After turning of the flange until the apex is reached with an advance a, the banding roll must be carried by the flange or front cover plate until both cover plates lie closely on the banding roll. During further rotation the flange must be retracted i.e. the apex must be passed. If spacing a is too large this is not possible, if spacing a is too small the package bands are not aligned.

In a particularly advantageous embodiment of the invention the roll core of the banding roll is not pushed directly onto the hub but onto projecting spring clamps. This is of essential significance because the roll core firstly need not be pushed onto the hub with force if the inner diameter lies in the lower tolerance range, but secondly does not wobble or flutter if it lies in the upper tolerance range.

The present invention therefore not only makes the clamping of the banding rolls easier and more secure, but also makes it less sensitive to production tolerances of the inner diameter of the roll core. Automatic alignment of the package band on the banding roll and automatic positioning of the roll core in the middle of the cover plates by the springing back of the released hub on complete rotation of the flange, automatically lead to the best solution.

BRIEF DESCRIPTION OF THE DRAWINGS

The invention is described below with reference to embodiment examples shown in the drawing which are also the subject of dependent claims. These show diagrammatically:

DETAILED DESCRIPTION

Figure 1:
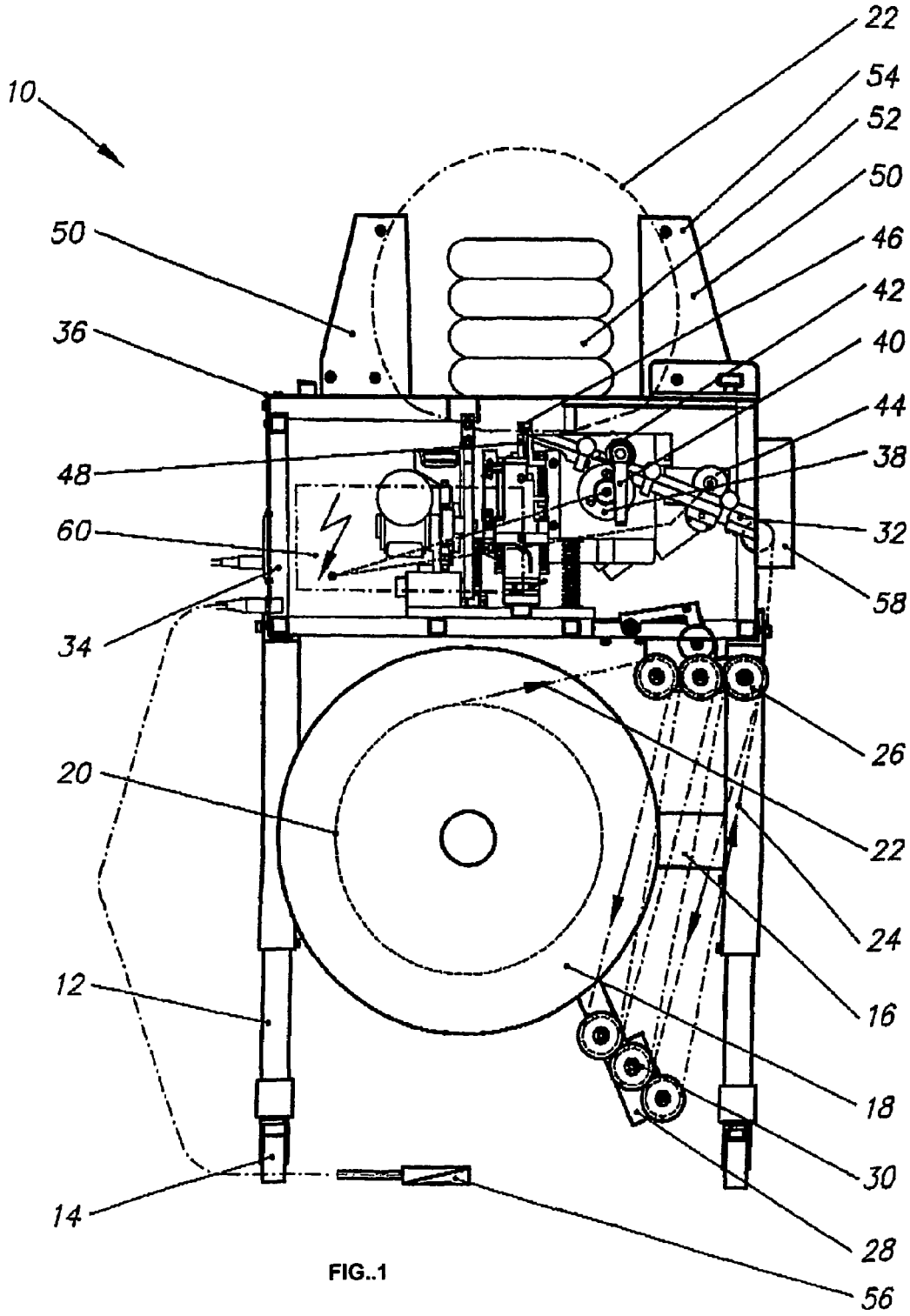
FIG. 1 a view of a banding machine with a banding roll.

FIG. 1 shows a banding machine 10 with height-adjustable chassis 12 on lockable wheels 14, where components not essential to the invention are also shown but not described specially since they are known to the expert. Mounted rotatably on a cross-brace 16 of the frame 12 is a front cover plate 18 with a banding roll 20. A package band 22 is unwound by way of a band store 24 which has three stationary deflection pulleys 26 and three deflection pulleys 30 mounted on the swivellable lever 28. If the loop is formed very quickly the band store 25 acts as a reserve, lever 28 is raised and lowers again under the effect of gravity.

After the band store 24, the package band 22 is drawn into a band channel 32 arranged in a machine housing 34 with a folding table panel 36. In this machine housing 34 are arranged further machine elements which are known in themselves, in particular a band drive roller 38, a transport roller 42 which with corresponding position of lever 40 presses the package band 22 against the band drive roller 38 or allows this to run freely, a rotary encoder roller 44 running precisely with the package band 22, a retaining plate 46, a welding and cutting unit 48 and a digital control 60 electrically connected with the drive of the band drive roller 38 and the rotary encoder roller 44.

The band guide 50 in the region of the stacked goods to be packaged 52 is mainly open, through two plane-symmetrically arranged support clamps 54 which can easily be supplemented with a horizontal channel which is open at the bottom, for example according to EP 0456604 A1.

Arranged below a folding cover 58 is a switch which as shown can also be formed as a foot switch 56.

Actuation of switch 56 activates the band drive roller 38 which pulls or pushes the package band 22 through the band guide 50 at high speed. After formation of an arc which is uncovered at the top, the front end of the package band 22 is clamped. The band drive roller 38 rotates in the opposite direction and pulls the package band about the inserted stack of goods to be packaged 52 with adjustable tension, which is called return.

Figure 2:
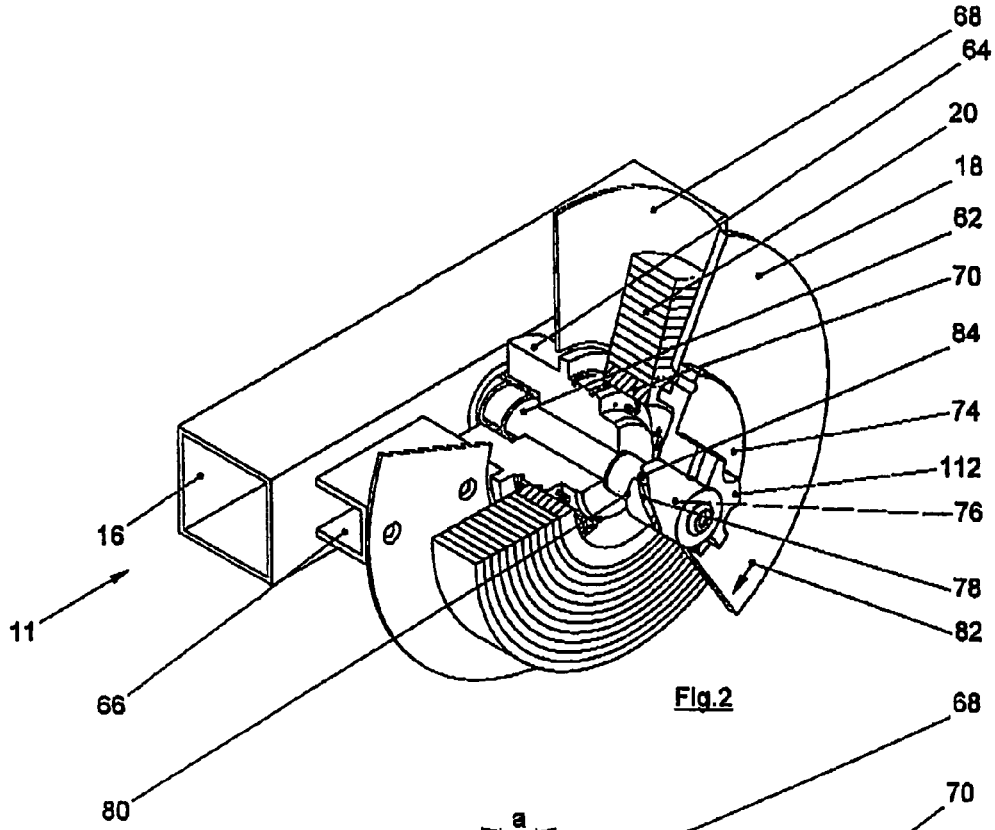
FIG. 2 a partly broken away view of an axial bearing of an applied banding roll, FIG. 3 a side view of FIG. 2, FIG. 4 the banding roll according to FIG. 2 with front and rear cover plates applied, FIG. 5 a side view according to FIG. 4, FIG. 6 the banding roll according to FIG. 2 in the end position, FIG. 7 a side view of FIG. 6, FIG. 8 an axial section through a banding roll in the position of FIG. 7
Figure 3:
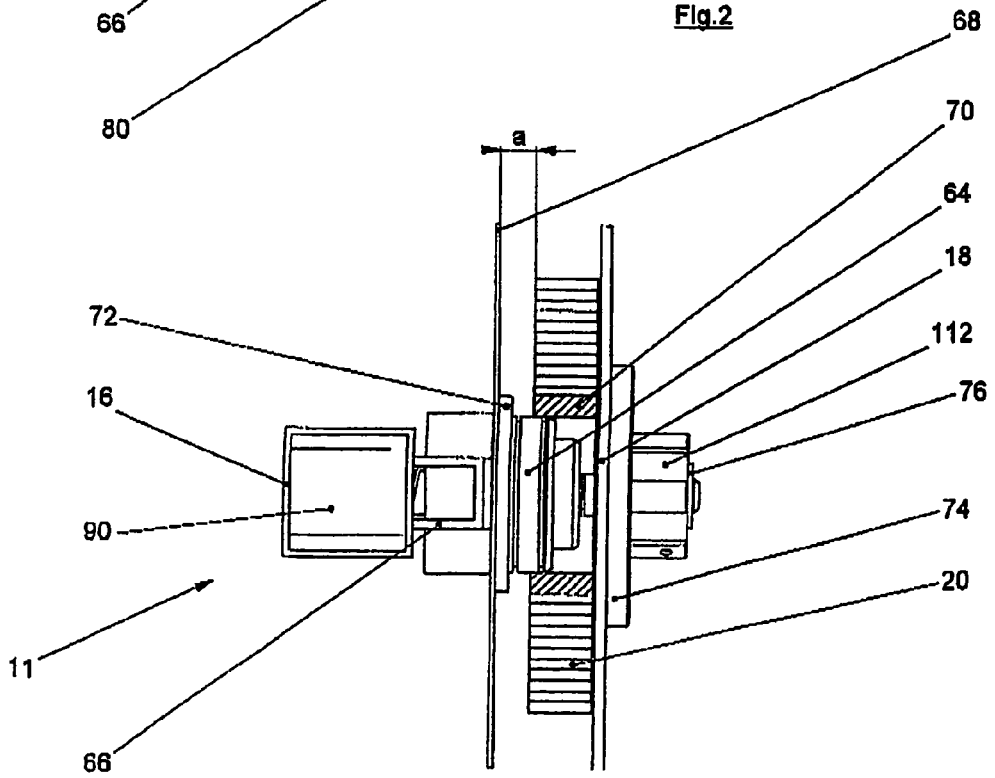

According to FIGS. 2 and 3, a shaft holder 90 of an axial bearing 11 holds a rigid shaft 62 running perpendicular to the machine frame 16 and has a free running hub 64. A rear cover plate 68 is attached to the machine frame 16 by way of a U-shaped bearing block 66.

As is evident in particular from FIG. 3, the banding roll 20 with a cardboard roll core 70 is pushed partly onto the hub 64. The front cover plate 18 is laid on the banding roll 20. The roll core 70 has spacing a from the rear cover plate 68.

The front cover plate 18 which lies on the banding roll 20 is integrated in a flange 74. With its inner bore the flange 74 lies coaxially on a bayonet socket 76 which in turn is mounted swivellably on the shaft 62. Radially outside the bayonet socket 76, the flange 74 is formed as a hand wheel with longitudinal ribs 112. The bayonet socket 76 which in the present case is formed sleeve-like has two diagonally opposing guide slots 78 which terminate open on the inner face 80 of the bayonet socket 76. In each of these guide slots 78 is guided a bolt 84 protruding perpendicularly from the shaft 62. The guide slots 78 are shown in detail in FIG. 9.

Figure 4:
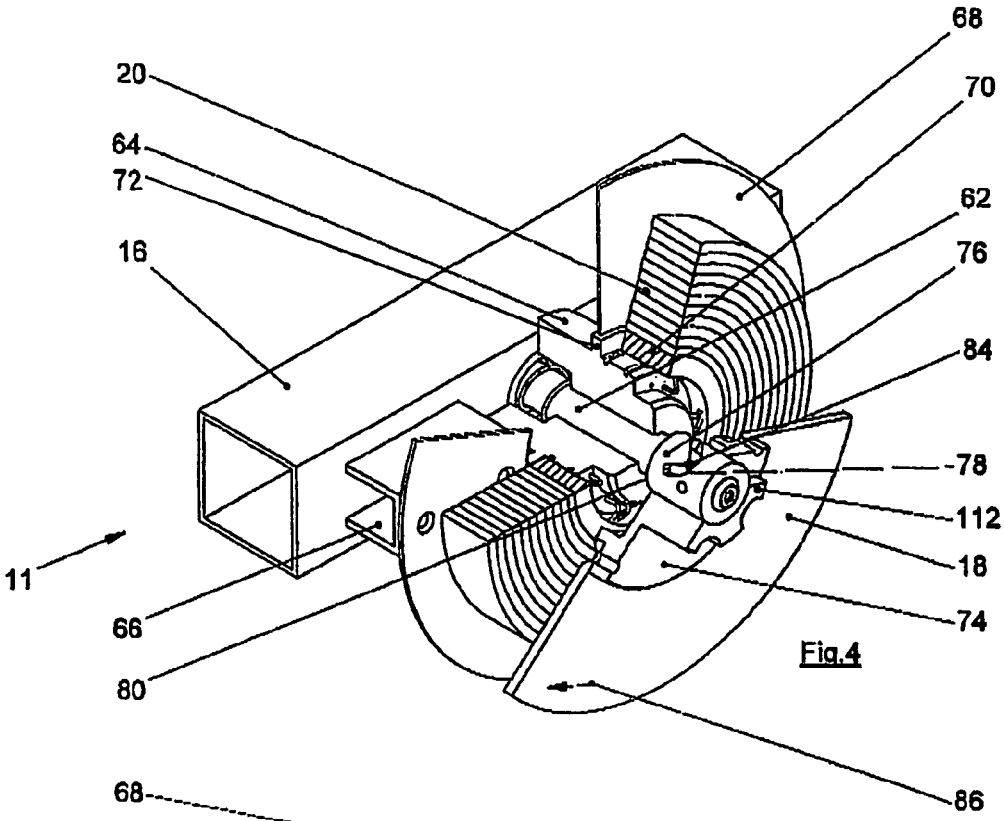
Figure 5:
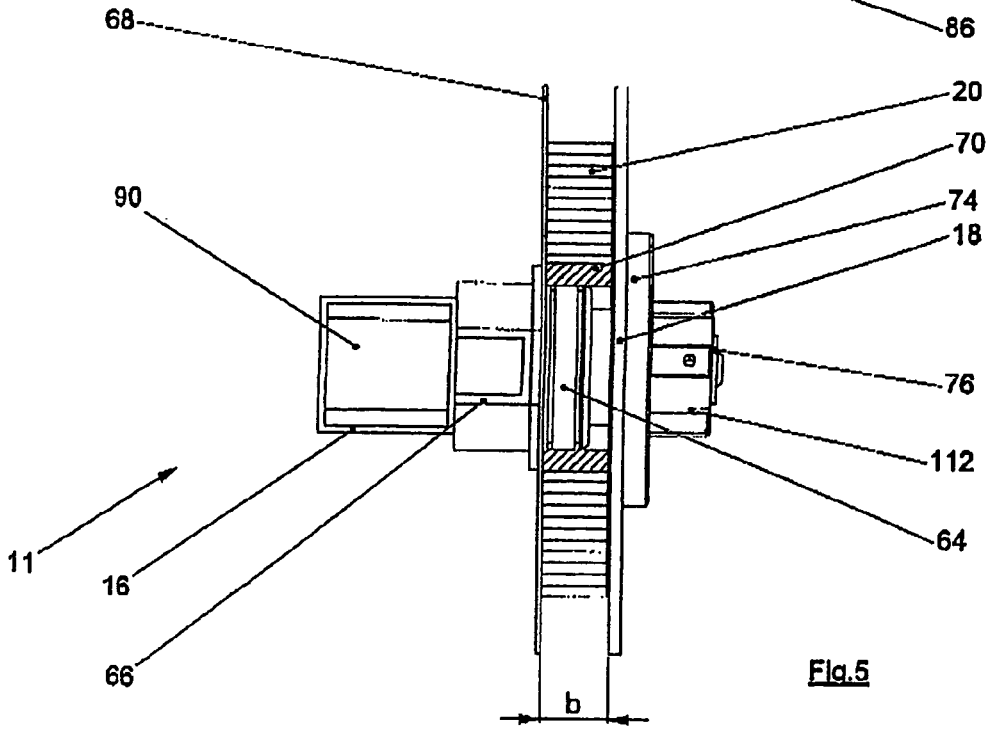
Figure 9:
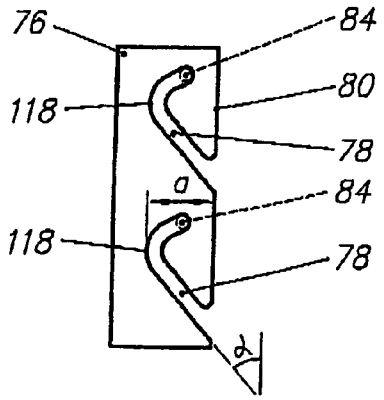
FIG. 9 the guide slot of the bayonet socket in the unwound view.

From this starting point on the inner face 80 of the bayonet socket 76, a unit comprising the flange 74, bayonet socket 76 and front cover plate 18 is turned with slight pressure in the axial direction of the shaft 62 in the direction of arrow 82, i.e. clockwise, until the contact point shown in FIGS. 4 and 5 is reached. The banding roll 20 of width b is now pushed further until the roll core 64 stops on step 72 of hub 64 and the rear cover plate 68 which is now surface-flush. At this contact point, laterally offset bands 22 of width b are also aligned to the banding roll 20. Step 72 of the pushed-back hub 64 and the rear cover plate 68 are now surface-flush. Hub 64 which is not only free running but also freely displaceable in the axial direction of shaft 62 is pressed against the cross brace 16. At this contact point the bolts 84 have reached the highest point in the guide slot 78, the apex 118 (FIG. 9).

Figure 6:
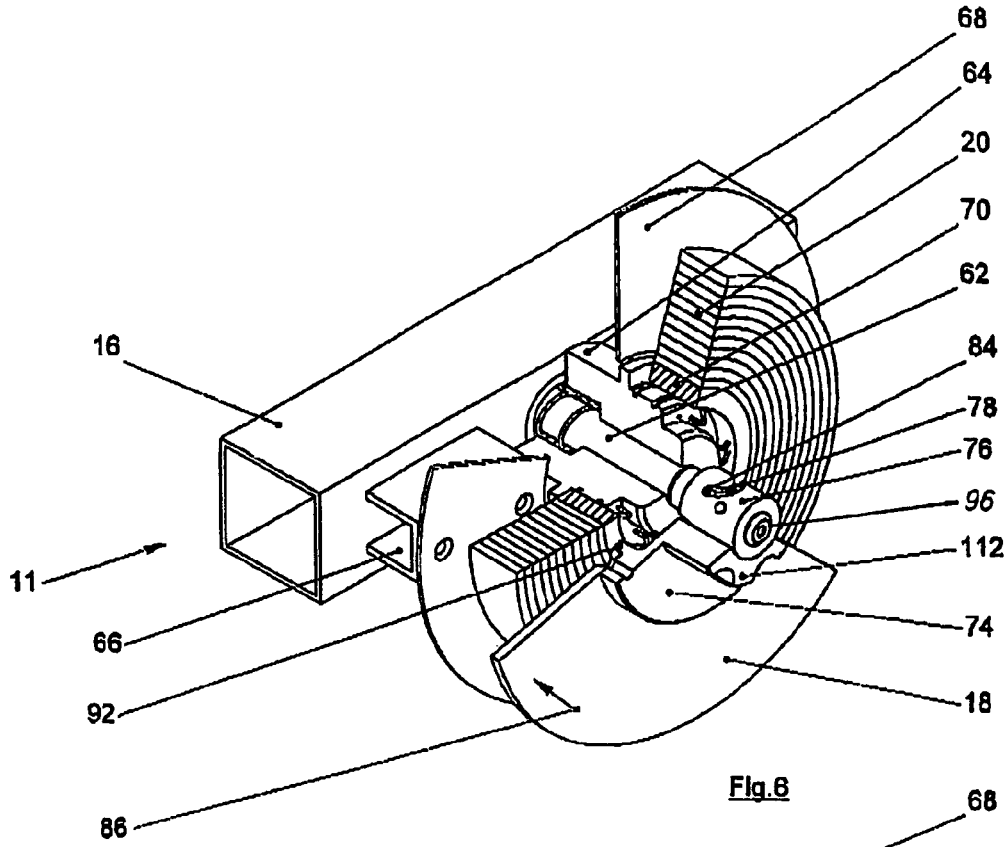
Figure 7:
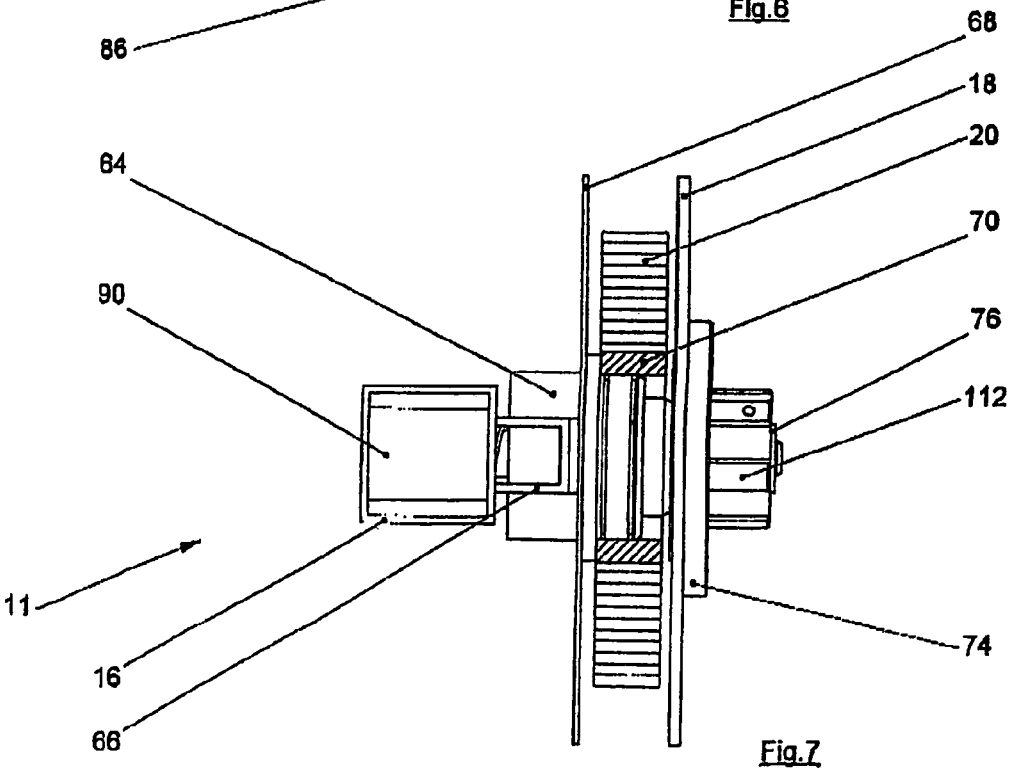

The unit comprising the flange 74, bayonet socket 76 and front cover plate 18 is now turned again clockwise in the direction of arrow 86 into the working point shown in FIGS. 6 and 7. Corresponding to the guide slot 78 with the guided bolts 84, the said unit has moved again in the direction of the free face 96 of the shaft 62. The banding roll 20 can spring back into the free position shown in FIG. 7 and now lies at a spacing from the front cover plate 18 and the rear cover plate 68. A compression spring 88 shown in FIG. 8 moves the hub 64 away from the shaft holder 90 and hence also away from the rear cover plate 68, hub 64 can now turn freely again together with the banding roll 20. A further compression spring 100 also removes the front cover plate 18 from the banding roll 20. On the inside of flange 74 is formed a ring stop 92 which has the same diameter as the roll core 70. The ring stop 92 suitably has an inner glide face. If the front cover plate 18 of the banding roll 20 comes too near, the ring stop 92 grinds on the roll core 70 and holds the banding material away from the front cover plate 18. Therefore only a small friction-induced loss occurs which is only a fraction of the friction loss which would occur if the banding material were to grind on the front cover plate 18.

Figure 8:
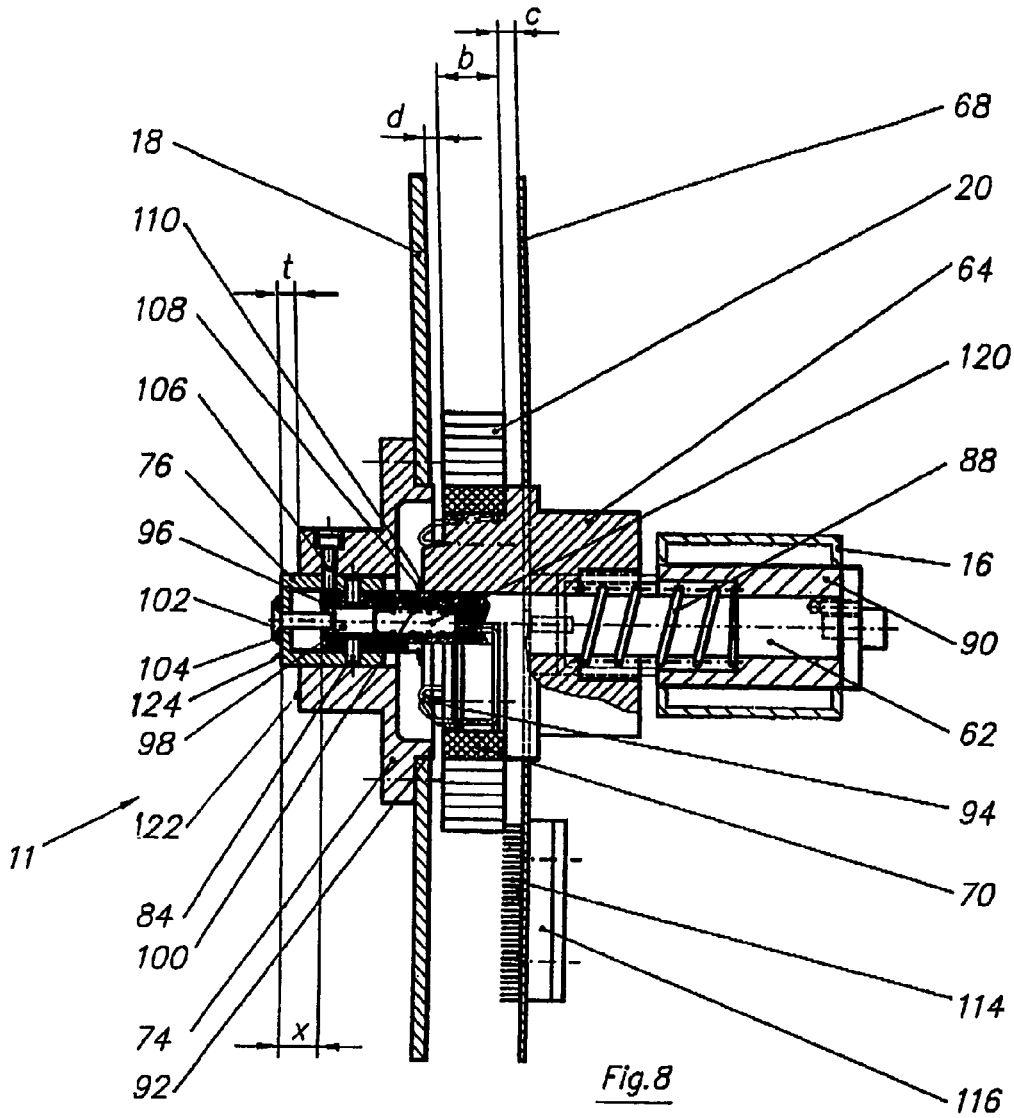
FIG. 8*a* is an enlarged view of the axial section of FIG. 8.
Figure 8A:
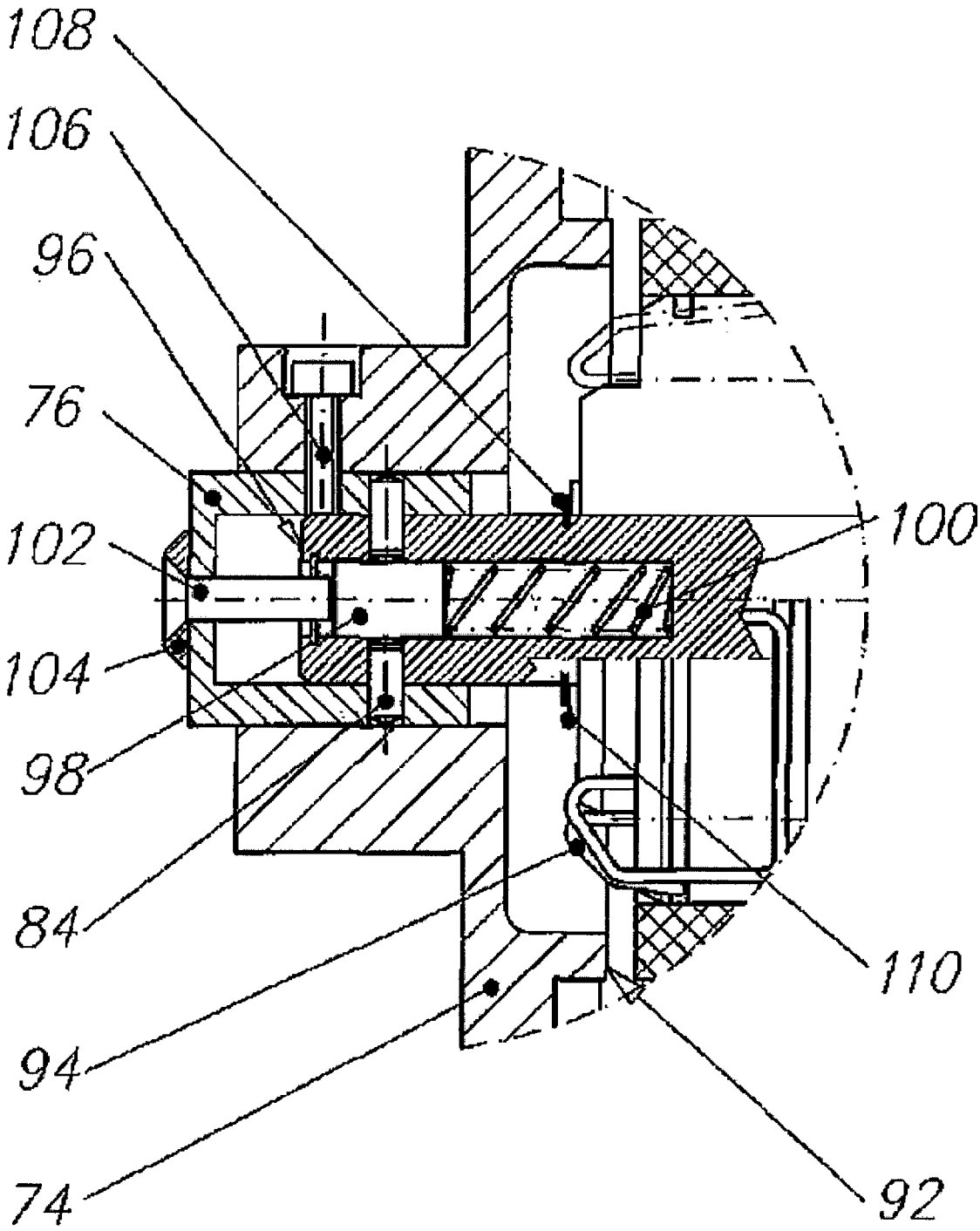

FIG. 8 and FIG. 8*a* show in detail the end or working position of the axial bearing 11 according to FIG. 6. The banding roll 20 has a width b in the present case of 15 mm, spacing c of the banding roll 20 from the rear cover plate 68 of around 5 mm, spacing d of the banding roll 20 from the front cover plate 18 around 4 mm. The banding roll 20 lies on the freely rotating hub 64. It is centred by way of spring clamps 94. The shaft 62 is fixed on the machine frame 16 by way of the shaft holder 90.

The compression spring 88 which surrounds the shaft 62 holds the hub 64 and the shaft holder 90 at an axial spacing of a few millimeters. If a force is exerted on the hub 64 this lies directly on the shaft holder 90. If the counter pressure is removed, the original spacing is restored and hub 54 springs back.

An axial bore 120 is recessed out of the shaft 62 from the free face 96. In this bore is inserted a pressure pad 98 which lies on a compression spring 100 in the bore 120. The spring force of the compression spring 100 is absorbed by a bolt 102 acting axially on the pressure pad 98 and screwed to the bayonet socket 76.

The bayonet socket 76 is screwed to the flange 74, the face 122 of flange 74 has a spacing t from the face 124 of the bayonet socket 76 that is adjustable according to the band width b of the package band 22. This spacing is fixed with a bolt 106.

On the face of the hub 64 in the part reaching into the flange 74, an Si ring 108 and a shim washer 110 are arranged on the shaft.

If a torque is exerted on the flange 74 in the area of the longitudinal ribs 112, the unit comprising the flange 74, bayonet socket 76 and front cover plate 18 is rotated, the bolts 84 which is anchored in the shaft 62 in the guide slots 78 cause an axial movement of the bayonet socket 76 and hence of the entire said unit in the direction of the rear cover plate 68. Spacing x of the face 124 of the bayonet socket 76 from the free face 96 of the shaft 62 changes according to the rotation, spacing t of the faces 122, 124 from flange 74 and bayonet socket 76 remains unchanged with the same band width b. The details are described in FIGS. 2 to 7.

Arranged on the rear cover plate 68 is a brass brush 114 as an earth contact with a spacer 116.

FIG. 9 shows the guide slots 78 with the apex 118 of the deflecting arc in detail. In particular spacing a of the apex 118 from the inner face 80 of the bayonet socket 76 and the pitch $\alpha$ of the guide slot 78 are evident. Bolts 84 are in the working position.

The invention claimed is:

1. An axial bearing (11) for a banding roll (20) of a banding machine (10) with a shaft (62) which is rigidly attached to a machine frame (16) or chassis, and a rear cover plate (68) which is also rigidly attached, a hub (64) which is freely rotatable on the shaft (62) and a flange (74) which is arranged on a free face (96) of the shaft (62) with a front cover plate (18), wherein in the area of the flange (74) at least one bolt (84) protrudes radially from the shaft (62) and engages without protrusion in a guide slot (78) of a bayonet socket (76) which is detachably connected with the flange (74), wherein the guide slot (78) is open at its inner face and transforms rising into a curved apex (118), turns at a spacing a from the inner face (80) of the bayonet socket (76) and runs ending blind in the direction of the inner face (80) of the bayonet socket, a compression spring (88) is arranged clamped between a shaft holder (90) and the hub (64) on the shaft (62) and presses a roll core (70) with the banding roll (20) over the hub (64) in the axial direction onto the flange (74) and together with this forms a fast closure with the centred banding roll (20), where a spacing (a) corresponds to the spacing of the roll core (70) of the banding roll (20), inserted and not yet pressed on, from the rear cover plate (68).

2. The axial bearing (11) according to claim 1, wherein two diagonally opposing bolts (84) protrude from the shaft (62) into the guide slots (78).

3. The axial bearing (11) according to claim 2, wherein the guide slots (78) for the bolts (84) run with preferably linear or degressive gradient, transform into a circular arc with each of the curved apex (118) and fall preferably linearly.

4. The axial bearing (11) according to claim 1, wherein the gradient of the guide slot (78) has an angle $\alpha$ of 30 to 60°.

5. The axial bearing (11) according to claim 1, wherein the guide slot (78) after the apex has an end position with a spacing of (0.3 to 0.7) from the inner face (80) of the bayonet socket (76).

6. The axial bearing (11) according to claim 5, wherein the guide slots have a catch after reaching the end position.

7. The axial bearing (11) according to claim 1, wherein a spacing (t) of a face (124) of the bayonet socket (76) from a free face (122) of the flange (74) is adjustable according to the width (b) of the banding roll (22).

8. The axial bearing (11) according to claim 7, wherein arranged in an axial bore (120) starting from the free face (96) of the shaft (62) is arranged a compression spring (100) and a longitudinally displaceable pressure pad (98), where the position of the pressure pad (98) and the associated bayonet socket (76) is adjustable with a bolt (102).

9. The axial bearing (11) according to claim 1, wherein the roll core (70) lies with play on the hub (64) and is centered with spring clamps (94).

10. The axial bearing (11) according to claim 1, wherein the flange (74) in the area of the inserted roll core (70) has a ring stop (92) which has an inner glide face.

11. The axial bearing (11) according to claim 1, wherein outside the roll core (70) and extending in the radial direction is arranged a brass brush (114) as an earth contact, the surface of which can be recessed via a spacer (116).

* * * * *